United States Patent [19]

Büttner et al.

[11] 4,373,947

[45] Feb. 15, 1983

[54] PROCESS FOR THE PREPARATION OF ALLOY POWDERS WHICH CAN BE SINTERED AND WHICH ARE BASED ON TITANIUM

[75] Inventors: Günter Büttner; Hans-Günter Domazer; Horst Eggert, all of Essen, Fed. Rep. of Germany

[73] Assignee: Th. Goldschmidt AG, Essen, Fed. Rep. of Germany

[21] Appl. No.: 260,178

[22] Filed: May 4, 1981

[30] Foreign Application Priority Data

May 9, 1980 [DE] Fed. Rep. of Germany ..... 3017782

[51] Int. Cl.[3] ..... C22B 5/04; C22B 34/12; C22C 1/04

[52] U.S. Cl. ..... 75/0.5 BB

[58] Field of Search ..... 75/0.5 BB

[56] References Cited

U.S. PATENT DOCUMENTS

| | | | |
|---|---|---|---|
| 2,287,771 | 6/1942 | Alexander | 75/0.5 BB |
| 2,800,404 | 7/1957 | Rostron et al. | 75/0.5 BB |
| 2,834,667 | 5/1958 | Rostron | 75/0.5 BB |
| 2,922,712 | 1/1960 | Raney | 75/0.5 BB |
| 2,984,560 | 5/1961 | Dombrowski | 75/0.5 BB |

*Primary Examiner*—W. Stallard

*Attorney, Agent, or Firm*—Toren, McGeady and Stanger

[57] ABSTRACT

A process is disclosed for the preparation of alloy powders, which can be sintered and which are based on titanium, by the calciothermal reduction of the oxides of the metals forming the alloys in the presence of neutral additives. This can be accomplished by mixing $TiO_2$ with oxides of the other components of the alloy, admixing an alkaline earth oxide or carbonate with the metal oxides, calcining the mixture. After cooling, the mixture is crushed and calcium is added. Thereafter, green compacts are formed which are heated and leached to remove the calcium oxide. The powder obtained is of uniform structure composition, is free of segrations of oxides nitrides carbides and/or hydrides and has high bulk and tap densities and can be molded by isostatic hot molding.

12 Claims, No Drawings

PROCESS FOR THE PREPARATION OF ALLOY POWDERS WHICH CAN BE SINTERED AND WHICH ARE BASED ON TITANIUM

BACKGROUND OF THE INVENTION

1. Field of the Invention

The invention relates to a process for the preparation of alloy powders. These alloys are based on titanium and can be sintered. They are prepared by the calciothermal reduction of the oxides of the metals which form the alloys in the presence of inert additives.

2. Description of the Prior Art

Because of their special properties, titanium and alloys based on titanium are very useful. However, due to the relatively costly manufacturing processes, titanium and especially alloys of titanium, are relatively expensive.

In the manufacture of titanium, the naturally occurring oxide is reduced with carbon in the presence of chlorine to produce titanium tetrachloride. This is reduced with metallic sodium or magnesium to titanium sponge. After the addition of further alloying components, such as, for example, aluminum and vanadium, the titanium sponge is then fused and cast or rolled into rods, shapes or sheets. The shaped parts having approximately the desired contour, are converted to their final form by machining. This mode of operation is advantageous since it produces considerable amounts of alloy cuttings. Consequently, it is not possible to economically produce parts having a complicated shape unless extra steps are taken, which increase the cost.

Manufacturing parts having such shapes is more successful using the powder metallurgy method. Two processes in particular have become known for the preparation of alloy powders. One process involves fusing the titanium sponge together with the alloying partners into a rod-shaped electrode. The electrode is dispersed to a powder by rotating at high rates of revolution under a plasma flame. However, because of the formation of agglomerates, the powder obtained must usually be subjected to an additional comminution or milling. This so-called "REP" process is exceptionally expensive, primarily due to the equipment cost. Also, it is limited, relative to the charge weight, to a particular size of electrode.

The second known method for the preparation of the powder consists of hydrogenation of the titanium sponge, milling the brittle titanium hydride, mixing it with the remaining alloying components in powder form, intimate milling, dehydrogenating at elevated temperatures under vacuum and molding and sintering the powder obtained by conventional procedures. This method is also expensive and is disadvantageous from a process engineering point of view.

German patent No. 935,456 discloses a process for the production of alloy powders suitable for the manufacture of sintered parts, by the reduction of metal compounds, and, if necessary, subsequently dissolving out the by-products. This process is characterized by the fact that intimate mixtures of such metal compounds, one of which at least is difficult to reduce, are reduced with metals, such as, sodium or calcium. In one embodiment of the process, the reduction takes place in the presence of inert, refractory, easily leachable materials.

This patent describes the co-reduction of oxides of titanium, copper and tungsten as well as of other oxides. The process has not been put into practice because it does not produce powders which can be sintered and which are homogeneous in regard to their composition and structure.

SUMMARY OF THE INVENTION

We have discovered a method for preparing alloy powders based on titanium which can be sintered and which does not have the above-described disadvantages. More particularly, the process of the present invention comprises the following steps:

(a) titanium oxide is mixed with the oxides of the other components of the alloy in amounts, based on the metals, corresponding to the desired alloy composition. Then alkaline earth oxide or alkaline earth carbonate is added in a molar ratio of metal oxides to be reduced to alkaline earth oxide or alkaline earth carbonate of 1:1 to 6:1. The mixture is homogenized, calcined at temperatures of 1000° C. to 1300° C. for 6 to 18 hours, cooled and comminuted to a particle size of $\leqq 1$ mm, (b) calcium is added to the comminuted particles in small pieces in an amount equivalent to 1.2 to 2.0 times the oxygen content of the oxides to be reduced, a booster is added in a molar ratio of oxide to be reduced to booster of 1:0.01 to 1:0.2, the reaction batch is mixed, and the mixture is molded into green compacts and filled into a reaction crucible which is closed off, (c) the reaction crucible is placed in a reaction furnace, which can be evacuated and heated, the reaction crucible is evacuated to an initial pressure of $1\times10^{-4}$ to $1\times10^{-6}$ bar and heated to a temperature of 1000° C. to 1300° C. for a period of 2 to 8 hours, and then cooled, an then (d) the reaction crucible is taken from the reaction furnace, the reaction product is removed from the reaction crucible and crushed and milled to a particle size of $\leqq 2$ mm, the calcium oxide is then leached out with a suitable dissolving agent which does not dissolve the alloy powder, and the alloy powder obtained is washed and dried.

With the process of the present invention, one can obtain alloy powders having controlled particle size and distribution. The alloy powders are uniform, that is, each powder particle corresponds to the other alloy particles in respect to its composition and structure. The alloy powders are free from segregations of oxides, nitrides, carbides and hydrides and are thus highly suitable for sintering. Because of the above-mentioned properties, the alloy powder is suitable for the production of shaped parts by molding and sintering. It is also possible to subject the powders to isostatic hot molding, by means of which components of the desired shape can be produced without expensive machining rework. The present method also allows the production of alloy powders of such uniformity and purity that they are suitable for the manufacture in the aircraft industry of parts, which will withstand high mechanical stresses.

DESCRIPTION OF THE PREFERRED EMBODIMENT

According to the process of the present invention, the oxides of the alloy components, corresponding to the desired alloy, are first of all prepared in amounts which, based on the metal, correspond to the alloy composition desired. In many experiments, it was apparent that an alloy powder, which can be sintered, cannot be obtained by the direct reduction of this mixture of oxides, independently of the pretreatment. Metal powders are formed which may consist partly of the desired alloy, but consist in uncontrollable amounts of pure titanium or of the metals or alloys of the other reaction components. Moreover, particles which contain titanium as a base and the remaining metal components alloyed in different amounts are present.

Surprisingly, these difficulties can be overcome by mixing the mixture of metal oxides to be reduced with certain amounts of alkaline earth oxide or alkaline earth carbonate and calcining to an oxide multicomponent system, the number of phases of which is less than the sum of the starting components (referred to herein as the mixed oxide).

In accordance with the invention, the molar ratio of the metal oxides to be reduced to the alkaline earth oxide or alkaline earth carbonate is 1:1 to 6:1 and, preferably, is in the range of about 1.2:1 to 2:1. Preferably, calcium oxide or calcium carbonate is used as the alkaline earth oxide or alkaline earth carbonate.

In contrast to the teachings of German Patent No. 935,456, the alkaline earth oxide and preferably the calcium oxide, is not added as a desensitizing agent, but serves for the preparation of a mixed oxide. After homogenization, the mixture of metal oxides to be reduced with the alkaline earth oxide or alkaline earth carbonate is calcined at temperatures of 1000° to 1300° C., preferably, 1200° to 1280° C., for 6 to 18 hours, and preferably, for 8 to 12 hours. In so doing, a mixed oxide with a lesser number of phases is formed, which, after comminution to a particle size of about $\leqq 1$ mm, has particles of the same gross composition.

It is of particular advantage to use an alkaline earth carbonate and preferably calcium carbonate, in place of the alkaline earth oxide. Calcium carbonate, for example, splits off carbon dioxide in the calcining process of the preparation of the mixed oxide. In so doing, calcium oxide with a fresh and active surface is formed. At the same time, the calcined mixed oxide is broken up and can then be comminuted more readily. The comminution of the calcined product is accomplished by a simple procedure, for example, by means of jawcrushers and subsequent milling in a jet mill.

In the second processing step, the calcined mixed oxide obtained is mixed with small pieces of calcium. In particular, the calcium should have a particle size of 0.5 to 8 mm and preferably of about 2 to 3 mm. The amount of calcium is related to the oxygen content of the oxides to be reduced. Based on the oxygen content of the oxides to be reduced, the 1.2 to 2.0-fold and, preferably, the 1.3 to 1.6-fold equivalent amount of calcium is used. Accordingly, for example, 2.4 to 3.6 moles of Ca are required per mole of $TiO_2$, 3.6 to 5.4 moles of Ca per mole of $Al_2O_3$ and 6.0 to 9.0 moles of Ca per mole of $V_2O_5$.

Of particular importance is the addition of a booster to the reaction mixture. In thermal processes involving metals, a booster is understood to be a compound which reacts with a strong exothermic heating effect in metallothermal reductions. Examples of such boosters are oxygen rich compounds, such as, for example, calcium peroxide, sodium chlorate, sodium peroxide, and potassium perchlorate. In selecting a booster, care should be taken that compounds are not introduced which would interfere as undesirable alloying components with the formation of the alloy. In the case of the inventive process, potassium perchlorate has proven to be an especially good booster. The reaction of potassium perchlorate with calcium is strongly exothermic. In addition, potassium perchlorate is relatively inexpensive. It is a particular advantage of potassium perchlorate that it can be obtained in an anhydrous form and is not very hygroscopic.

The use of a booster in accordance with the present invention in the calciothermal co-reduction, is in direct contradiction to the teachings of German patent No. 935,456. The opinion is expressed there that the reduction would take place with so great an evolution of heat that the resulting fused mass of alloy or the resulting powder would be obtained in a very coarse form. German patent No. 935,456 therefore teaches that, in such cases, an inert, refractory compound, and especially oxides, should be added to the reaction mixture. In the case of the inventive process, however, the addition of a booster leads to alloy powders in which the individual particles always have the same composition and shape required for achieving the desired high tap and bulk density.

The molar ratio of oxides to be reduced to booster is 1:0.01 to 1:0.2 and, preferably, 1:0.03 to 1:0.13. The reaction charge, consisting of the oxides, calcium and booster, is now intimately mixed.

It is possible to add one or more of the desired alloy powders in the form of a metal powder of particle size $\leqq 40$ μm to the reaction mixture in step (b). However, because of the problems in obtaining a uniform distribution of the added metal powder in the oxide mixture, this is recommended only when the corresponding oxide of the metal sublimes at relatively low temperatures and therefore cannot be calcined together with the other oxides in step (a) without loss. An example of such a metal is molybdenum. Molybdenum trioxide sublimes at temperatures $\leqq 760°$ C. and is advantageously added in the form of a fine metal powder to step (b). The mixture is molded into green compacts. These green compacts are filled into a reaction crucible. If green compacts of cylindrical shape are used, it turns out that a high degree of filling is achieved, a uniform reaction is attained by suitable heat transfer and, at the same time, the reduced reaction product can be removed perfectly from the crucible. The green compacts should have a diameter of about 50 mm and height of 30 mm. Deviations from these dimensions are, of course, possible.

The green compacts are now filled into a reaction crucible. A reaction crucible is used, which is chemically and mechanically stable under the given conditions. For this purpose, crucibles of titanium sheet metal are particularly advantageous.

In the third processing step, the reaction crucible is now closed. In the lid which closes off the crucible, there is a socket of small internal diameter, through which the crucible can be evacuated. The reaction crucible is placed in a heatable reaction furnace and evacuated to an initial pressure of about $1\times10^{-4}$ to $1\times10^{-6}$ bar. The reaction crucible is now heated to a temperature of 1000° C. to 1300° C. In so doing, some calcium distills into the evacuation socket, condenses there and closes it off. Such a self-closing crucible is known, for example, from German Auslegeschrift No. 1,124,248. The pressure now increases in the reaction crucible, corresponding to the pressure of the calcium at the given temperature. Calcium, bound as the oxide and removed from the equilibrium, can be disregarded, because the formation of gaseous calcium is more rapid than the elimination reaction. The reaction crucible is left at the reaction temperature for about 2 to 8 hours and preferably, for 2 to 6 hours.

In a particular embodiment of the inventive process, the gaseous potassium, which is formed by the reduction of the potassium perchlorate used as the booster and which passes through the evacuation socket of the reaction crucible before this socket is closed off by condensed calcium, is absorbed in an intermediate vessel which is filled with silica gel.

Surprisingly, it turns out that the gaseous potassium is absorbed by the silica gel in such a form that the potassium-laden silica gel can be handled safely in air. If such a laden silica gel is added to water, hydrogen is evolved slowly and over a long period of time, so that the metallic potassium can be absorbed and disposed of safely in this manner.

During the reaction period, the booster, and especially the potassium perchlorate, is reduced. Besides metallic potassium, calcium oxide and calcium chloride are formed. Through the heat released here, the reduction of the metal oxides is favored and accelerated. During and after the reduction, the formation of the desired alloy takes place. The melt temperature of the alloy, which is surrounded on all sides by calcium oxide, is briefly exceeded. As a consequence, and supported by the molten liquid calcium chloride and the action of surface tension, the particles of alloy are formed in the desired form of an approximately spherical shape.

In the last processing step, the reaction crucible is now taken out to the furnace, the crucible is opened, the reaction product is removed from the crucible and crushed and milled to a particle size of $\leqq 2$ mm. The calcium oxide is leached out with a suitable dissolving agent, especially with dilute acids, for example, dilute acetic acid or dilute hydrochloric acid, or with a complexing agent, such as, ethylenediamine tetraacetic acid. The residual alloy powder is washed until it is neutral and dried.

It has proven to be advantageous, to carry out one or more of the processing steps under the atmosphere of a protective gas. Preferably, argon is used as the protective gas. An especially preferred embodiment of the inventive process is therefore characterized by the fact that one or more processing steps are carried out under the atmosphere of a protective gas and particularly, one or more of the following steps:

(a) cooling the calcined oxide mixture, comminuting the calcined oxide mixture, (b) mixing the reaction mixture, molding the reaction mixture to green compacts, filling the green compacts into the reaction crucible, (c) placing the reaction crucible into the heatable furnace, (d) removing the reaction crucible from the reaction furnace, removing the reaction product from the reaction crucible, comminuting, leaching, drying the reaction product.

If the reduced reaction product, obtained in processing step (c), contains hydrogen in an impermissible amount, it is advisable to subject the reduction product to a vacuum treatment at $1\times10^{-4}$ to $1\times10^{-7}$ bar at a temperature of 600° to 1000° C., preferably, of 800° to 900° C., for a period of 1 to 8 hours, preferably, 2 to 3 hours.

As a consequence of its particle size and particle size distribution, the inventively obtained alloy powder has the required tap density of about $\geqq 60\%$ of the theoretical density. Tap densities up to almost 70% of the theoretical value are achieved. An investigation of the alloy powder by microscopic examination of polished sections as well as with a microprobe confirm a uniform distribution of each individual alloy particle. They are free of segregations which would impair the ability to sinter or reduce the capacity of the parts obtained by isostatic hot molding to withstand mechanical stresses.

Alloys, such as, for example, TiAl6V4, TiAl6V6Sn2, TiAl4Mo4Sn2, TiAl6Zr5Mo0,5SiO,25, TiAl2V11,5Zr11Sn2, and TiAl3V10Fe3 which are standard in respect to their properties can be prepared perfectly.

Additional advantages of the inventive process result from the fact that the raw materials, namely, the oxides of the metals, are available in practically an unlimited amount. Apart from purification, they require no special working up. By selecting the nature and amount of the metal oxides to be reduced, alloys of the desired composition can be prepared without complications. The yields are very high (>96%) in the inventive process, because no loss-causing intermediate steps are required, as they are in the state of the art process. The inventive process is therefore particularly inexpensive. Expenditures for equipment are minimal and reproducibility of alloys, prepared in accordance with the process, is high. Alloy powders, which can be sintered, may be prepared from naturally occuring, purified raw materials, while avoiding remelting processes.

The following examples illustrate the inventive process:

EXAMPLE 1

Preparation of a TiAl6V4 Alloy 1377.10 g $TiO_2$, 85.63 g $Al_2O_3$, 65.60 g $V_2O_5$, and 1601.2 g $CaCO_3$ are mixed homogeneously and calcined at 1100° C. for 12 hours. The calcined mixed oxide is crushed and milled by means of a jawcrusher and a jet mill to a particle size of <1 mm and has the following particle distribution curve: (w/o—weight percent)

| | |
|---|---|
| >500 μm = 2.2 w/o | |
| 355–500 μm = 21.4 w/o | 63–90 μm = 23.8 w/o |
| 250–355 μm = 14.0 w/o | 45–63 μm = 11.0 w/o |
| 180–250 μm = 9.8 w/o | 32–45 μm = 3.8 w/o |
| 125–180 μm = 6.8 w/o | 25–32 μm = 1.2 w/o |
| 90–125 μm = 5.7 w/o | <25 μm = 0.2 w/o |

The bulk density is ca. 1.40 g/cc and the tap density ca. 2.30 g/cc. After the calcining, the yield of mixed oxide phases is 2418.0 g=ca. 99.7%.

1000 g of this mixed oxide is mixed homogeneously with 1070.6 g Ca and 91.40 g $KClO_4$ (=0.08 moles $KClO_4$/mole of alloy powder) and green compacts with the dimensions of a diameter of 50 mm and a height of 30 mm are prepared from this mixture. Subsequently, the green compacts are reduced in a titanium crucible at an initial pressure of $1.10^{-5}$ bar and a temperature of 1150° C. for 8 hours, cooled and crushed and milled after the reduction to a particle size of <2 mm, the reaction product is leached with dilute hydrochloric acid, and the alloy powder obtained is vacuum treated and dried. The yield of alloy powder is ca. 361.0 g=ca. 95.6%, based on the theoritical yield.

The alloy powder obtained has a bulk density of 1.96 g/cc=ca. 44.95% and a tap density of 2.56 g/cc=ca. 58.6% of the theoritical density.

The particle distribution curve has the following composition:

| | |
|---|---|
| >500 μm = 1.5 w/o | 63-90 μm = 4.6 w/o |
| 355-500 μm = 1.2 w/o | 45-63 μm = 9.6 w/o |
| 250-355 μm = 1.3 w/o | 32-45 μm = 10.5 w/o |
| 180-250 μm = 2.7 w/o | 25-32 μm = 10.1 w/o |
| 125-180 μm = 3.5 w/o | <25 μm = 49.0 w/o |
| 90-125 μm = 4.9 w/o | |

Chemical analysis of the alloy powder reveals the following composition:

Al=5.85 w/o
V=3.93 w/o
Fe=0.05 w/o
Si=<0.05 w/o
H=0.008 w/o
N=0.0160 w/o
C=0.07 w/o
O=0.11 w/o
Ca=0.07 w/o
Mg=<0.01 w/o
rest Ti A metallographic investigation of the alloy powder shows that the alloy particles are present in a structurally homogeneous form, the arrangement of the structure being classified as lamellar to fine globular. A homogeneous distribution can be identified between a high α-portion and a low β-portion in the alloy.

EXAMPLE 2

Preparation of a TiAl6V4 Alloy

For a second alloy, 1377.10 g $TiO_2$, 85.63 g $Al_2O_3$, 65.60 g $V_2O_5$ and 644.9 g MgO are homogeneously mixed and calcined at 1250° C. for about 12 hours, the calcined oxide obtained being treated as in Example 1.

The mixed oxide, after comminution, has the following particle distribution:

| | |
|---|---|
| >500 μm = 0.5 w/o | 63-90 μm = 14.2 w/o |
| 355-500 μm = 0.2 w/o | 45-63 μm = 21.4 w/o |
| 250-355 μm = 0.8 w/o | 32-45 μm = 11.0 w/o |
| 180-250 μm = 1.6 w/o | 25-32 μm = 8.8 w/o |
| 125-180 μm = 5.4 w/o | <25 μm = 19.8 w/o |
| 90-125 μm = 16.2 w/o | |

The bulk density of the comminuted mixed oxide is ca. 1.33 g/cc, the tap density ca. 1.97 g/cc. After calcining, the mixed oxide is obtained in a yield of 2154.9 g=ca. 99.16%.

895 g of mixed oxide are intimately mixed with 1290 g Ca and 133 g $KClO_4$ (=0.12 moles $KClO_4$/mole of alloy powder), calcined for 12 hours at 1100° C. and treated further as in Example 1.

The yield of titanium alloy powder is 365.5 g, corresponding to 96.75% of the theoretically possible yield. The alloy powder has a bulk density of 2.14 g/cc=ca. 48.97% and a tap density of 2.78 g/cc=ca. 63.76%, based on the theoretical density.

The particle distribution curve of the alloy powder has the following composition:

| | |
|---|---|
| >500 μm = 0.6 w/o | 63-90 μm = 5.6 w/o |
| 355-500 μm = 0.7 w/o | 45-63 μm = 11.3 w/o |
| 250-355 μm = 0.8 w/o | 32-45 μm = 25.9 w/o |
| 180-250 μm = 1.7 w/o | 25-32 μm = 25.2 w/o |
| 125-180 μm = 2.7 w/o | <25 μm = 21.6 w/o |
| 90-125 μm = 3.9 w/o | |

Chemical analysis reveals the following composition:

| | |
|---|---|
| Al = 5.96 w/o | C = 0.08 w/o |
| V = 3.96 w/o | O = 0.14 w/o |
| Fe = 0.07 w/o | Ca = 0.08 w/o |
| Si = <0.05 w/o | Mg = 0.02 w/o |
| H = 0.010 w/o | rest Ti |
| N = 0.0120 w/o | |

From the results of the metallographic examination, it may be deduced that the particles of alloy have the same structure, which can be characterized largely as lamellar to fine globular. The arrangement of the structure moreover shows that the particles of alloy have a homogeneous α and β phase distribution.

EXAMPLE 3

Preparation of a TiAl6V6Sn2 Alloy 1334.40 g $TiO_2$, 103.90 g $Al_2O_3$, 99.3 g $V_2O_5$, 45.15 g SnO and 1601.2 g $CaCO_3$ are intimately or homogeneously mixed and calcined for ca. 12 hours at 1250° C. The calcined oxide is crushed and milled with a jaw-crusher and a jet mill to a particle size of <1 mm=ca. 1000 μm and has the following particle distribution curve:

| | |
|---|---|
| >500 μm = 0.8 w/o | 63-90 μm = 18.9 w/o |
| 355-500 μm = 0.9 w/o | 45-63 μm = 20.3 w/o |
| 250-355 μm = 1.5 w/o | 32-45 μm = 12.0 w/o |
| 180-250 μm = 2.4 w/o | 25-32 μm = 8.0 w/o |
| 125-180 μm = 6.9 w/o | <25 μm = 13.8 w/o |
| 90-125 μm = 14.3 w/o | |

The bulk density of the comminuted oxide is 1.63 g/cc and the tap density ca. 2.58 g/cc. After calcining, the mixed oxide is obtained in a yield of 2415.0 g=ca. 97.4%.

1000 g of this mixed oxide are homogeneously mixed with 1133.9 g Ca and 129.8 g $KClO_4$ (0.12 moles $KClO_4$/mole of alloy powder), compacted, reduced for 8 hours at 1150° C. and, as described in Example 1, processed further. The yield of titanium alloy powder is 367.2 g, corresponding to 96.5% based on the theoretical yield.

The alloy powder has a bulk density of 2.18 g/cc=ca. 49.3% and a tap density of 2.81 g/cc=ca. 63.45% of the theoretical density.

The particle distribution curve of the alloy powder has the following composition:

| | |
|---|---|
| >500 μm = 2.1 w/o | 63-90 μm = 10.2 w/o |
| 355-500 μm = 1.4 w/o | 45-63 μm = 16.7 w/o |
| 250-355 μm = 1.4 w/o | 32-45 μm = 31.9 w/o |
| 180-250 μm = 2.4 w/o | 25-32 μm = 20.3 w/o |
| 125-180 μm = 3.1 w/o | <25 μm = 4.5 w/o |
| 90-125 μm = 5.8 w/o | |

Chemical analysis reveals the following composition:

| | |
|---|---|
| Al = 6.05 w/o | N = 0.010 w/o |
| V = 5.80 w/o | C = 0.09 w/o |
| Sn = 1.90 w/o | O = 0.145 w/o |
| Fe = 0.12 w/o | Ca = 0.10 w/o |
| Si = 0.06 w/o | Mg = <0.01 w/o |

-continued

| | |
|---|---|
| H = 0.012 w/o | rest Ti |

A metallographic examination reveals particles of alloy with a homogeneous arrangement of structure and phase distribution. The structure shows a finely lamellar structure of the $\alpha$ phase, which is stabilized by additions of tin. $Ti_3Al$ phases, which hinder noncutting shaping, are not present.

EXAMPLE 4

Preparation of a TiAl4Mo4Sn2 Alloy 1439.5 g $TiO_2$, 72.5 g $Al_2O_3$, 21.8 g SnO and 1601.2 g $CaCO_3$ are mixed homogeneously and calcined for ca. 12 hours at 1250° C. Subsequently, the calcined mixed oxide is crushed and milled by means of a jawcrusher and a jet mill to a particle size <1 mm. The mixed oxide has the following particle distribution curve:

| | |
|---|---|
| >500 μm = 1.2 w/o | 63–90 μm = 20.3 w/o |
| 355–500 μm = 2.1 w/o | 45–63 μm = 25.0 w/o |
| 250–355 μm = 2.8 w/o | 32–45 μm = 14.0 w/o |
| 180–250 μm = 3.6 w/o | 25–32 μm = 6.5 w/o |
| 125–180 μm = 8.9 w/o | <25 μm = 3.5 w/o |
| 90–125 μm = 11.9 w/o | |

The bulk density of the mixed oxide is 1.84 g/cc and the tap density ca. 2.76 g/cc. The yield of usable mixed oxide is ca. 2358.0 g=ca. 98.1% of the theoritical yield.

1000 g of this mixed oxide are homogeneously mixed with 24.9 g of Mo powder, 1109.1 g Ca and 115.3 g $KClO_4$, compacted and treated further as described in Example 1. The yield of titanium alloy powder is 384.8 g=96.5% of the theoretical yield.

The alloy powder has a bulk density of 2.39 g/cc=ca. 52.8% and a tap density of 2.88 g/cc=ca. 63.6% of the theoretical density.

The particle distribution curve has the following composition:

| | |
|---|---|
| >500 μm = 1.8 w/o | 63–90 μm = 13.8 w/o |
| 355–500 μm = 2.5 w/o | 45–63 μm = 18.8 w/o |
| 250–355 μm = 3.4 w/o | 32–45 μm = 32.4 w/o |
| 180–250 μm = 4.1 w/o | 25–32 μm = 7.4 w/o |
| 125–180 μm = 7.3 w/o | <25 μm = 2.5 w/o |
| 90–125 μm = 5.7 w/o | |

Chemical analysis of the alloy powder reveals the following composition:

| | |
|---|---|
| Al = 3.80 w/o | N = 0.009 w/o |
| Mo = 4.20 w/o | C = 0.07 w/o |
| Sn = 1.85 w/o | O = 0.11 w/o |
| Fe = 0.10 w/o | Ca = 0.09 w/o |
| Si = 0.08 w/o | Mg = <0.01 w/o |
| H = 0.10 w/o | rest Ti |

A metallographic examination reveals alloy particles with a homogeneous arrangement of the structure. Besides the stabilized $\alpha$ phase as maint component, a smaller $\beta$ portion is present in the alloy particles.

EXAMPLE 5

Preparation of a TiAl6Zr5Mo0, 5SiO,25 Alloy 1379.9 g $TiO_2$, 106.3 g $Al_2O_3$, 63.3 g $ZrO_2$, 10.7 g $SiO_2$ and 1601.2 g $CaCO_3$ are homogeneously mixed and calcined for 12 hours at 1250° C. Subsequently, the calcined mixed oxide is crushed and milled by means of a jawcrusher and a jet mill to a particle size of <1 mm≅1000 μm. The particle distribution curve has the following composition:

| | |
|---|---|
| >500 μm = 1.3 w/o | 63–90 μm = 12.1 w/o |
| 355–500 μm = 17.4 w/o | 45–63 μm = 19.1 w/o |
| 250–355 μm = 11.3 w/o | 32–45 μm = 13.8 w/o |
| 180–250 μm = 9.4 w/o | 25–32 μm = 3.8 w/o |
| 125–180 μm = 6.2 w/o | <25 μm = 0.6 w/o |
| 90–125 μm = 4.6 w/o | |

The bulk density of the mixed oxide is ca. 2.12 g/cc≅48.11% and the tap density ca. 2.54 g/cc=ca. 57.65% of the theoritical density. The yield of usable mixed oxide is ca. 2425.0 g and corresponds to 98.7% of the theoritical yield.

1000 g of this mixed oxide are homogeneously mixed with 1.91 g of very fine-grained molybdenum metal powder, 1125.9 g Ca and 131.2 g $KClO_4$ (0.12 g $KClO_4$/mole of alloy powder) and processed further as described in Example 1. The yield of titanium alloy powder is 369.4 g=ca. 96.6%, based on the theoretical yield of alloy powder.

The alloy powder has a bulk density of 2.12 g/cc=ca. 48.11% and a tap density of 2.68 g/cc=ca. 60.9% of the theoretical density.

The alloy powder has the following particle distribution curve:

| | |
|---|---|
| >500 μm = 1.1 w/o | 63–90 μm = 18.4 w/o |
| 355–500 μm = 6.3 w/o | 45–63 μm = 18.0 w/o |
| 250–355 μm = 4.4 w/o | 32–45 μm = 7.6 w/o |
| 180–250 μm = 11.2 w/o | 25–32 μm = 4.3 w/o |
| 125–180 μm = 12.0 w/o | <25 μm = 7.6 w/o |
| 90–125 μm = 8.9 w/o | |

Chemical analysis of the alloy powder revealed the following composition:

| | |
|---|---|
| Al = 5.87 w/o | C = 0.08 w/o |
| Zr = 4.90 w/o | O = 0.15 w/o |
| Mo = 0.45 w/o | Ca = 0.12 w/o |
| Si = 0.26 w/o | Mg = 0.01 w/o |
| H = 0.012 w/o | rest Ti |
| N = 0.0180 w/o | |

Metallographic examinations show that alloy particles of homogeneous structure are present, there being a distinct $\beta$-stabilized arrangement of structure which, after sintering, endows this alloy with the well-known higher termal stability.

EXAMPLE 6

Preparation of a TiAl2V11,5Zr11Sn2 Alloy 1245.22 g $TiO_2$, 38.0 g $Al_2O_3$, 207.5 g $V_2O_5$, 149.4 g $ZrO_2$, 23.1 g SnO and 1601.2 g $CaCO_3$ are intimately or homogeneously mixed and calcined for 12 hours at 1250° C. The calcined mixed oxide is crushed and milled by means of a jawcrusher and a jet mill to a particle size of <1 mm=ca. 1000 μm and then has the following particle distribution curve:

| | |
|---|---|
| >500 μm = 3.2 w/o | 63–90 μm = 14.8 w/o |
| 355–500 μm = 10.3 w/o | 45–63 μm = 18.1 w/o |
| 250–355 μm = 11.0 w/o | 32–45 μm = 12.6 w/o |

-continued

| | |
|---|---|
| 180–250 μm = 12.5 w/o | 25–32 μm = 2.4 w/o |
| 125–180 μm = 8.4 w/o | <25 μm = 0.3 w/o |
| 90–125 μm = 5.9 w/o | |

The bulk density of the calcined mixed oxide is 2.415 g/cc=ca. 50.15% and the tap density is 3.185 g/cc≅66.2% of the theoritical density. The yield of usable mixed oxides is 2412.2 g, corresponding to 94.2% of the theoritical yield.

1000 g of this mixed oxide are homogeneously mixed with 1640.2 g Ca and 162.3 g $KClO_4$ (0.10 moles $KClO_4$/mole of alloy powder) and processed further as described in Example 1. The yield of alloy powder is 378.2 g=ca. 95.55% of the theoretical yield.

The alloy powder has a bulk density of 2.68 g/cc=ca. 55.65% and a tap density of 3.13 g/cc=ca. 65.1% of the theoretical density.

The alloy powder has the following particle distribution curve:

| | |
|---|---|
| >500 μm = 1.8 w/o | 63–90 μm = 15.9 w/o |
| 355–500 μm = 5.8 w/o | 45–63 μm = 14.1 w/o |
| 250–355 μm = 6.3 w/o | 32–45 μm = 4.1 w/o |
| 180–250 μm = 10.2 w/o | 25–32 μm = 8.9 w/o |
| 125–180 μm = 13.2 w/o | <25 μm = 12.9 w/o |
| 90–125 μm = 6.2 w/o | |

Chemical analysis of the alloy powder reveals the following composition:

| | |
|---|---|
| Al = 1.90 w/o | N = 0.014 w/o |
| V = 11.20 w/o | C = 0.07 w/o |
| Zr = 10.70 w/o | O = 0.10 w/o |
| Sn = 1.80 w/o | Ca = 0.10 w/o |
| Si = <0.05 w/o | Mg = <0.01 w/o |
| Fe = <0.05 w/o | rest Ti |
| H = 0.010 w/o | |

A metallographic examination of the alloy powder shows particles with a homogeneous arrangement of the structure and β stabilization. Sintered parts, manufactured from these alloys produce components with a relatively high fracture toughness.

EXAMPLE 7

Preparation of a TiAl3VlOFe3 Alloy 1325.2 g $TiO_2$, 55.2 g $Al_2O_3$, 168.6 g $V_2O_5$, 39.4 g $Fe_3O_4$ and 1601.2 g $CaCO_3$ are homogeneously mixed and calcined for 12 hours at a temperature of 1100° C. Subsequently, the calcined mixed oxide is crushed and milled by means of a jaw-crusher and a jet mill to a particle size <1 mm=ca. 1000 μm. After that, the particle distribution curve has the following composition:

| | |
|---|---|
| >500 μm = 1.8 w/o | 63–90 μm = 18.2 w/o |
| 355–500 μm = 8.9 w/o | 45–63 μm = 17.5 w/o |
| 250–355 μm = 10.3 w/o | 32–45 μm = 10.1 w/o |
| 180–250 μm = 13.4 w/o | 25–32 μm = 1.6 w/o |
| 125–180 μm = 9.3 w/o | <25 μm = 0.1 w/o |
| 90–125 μm = 7.5 w/o | |

The bulk density of the calcined mixed oxide is 2.314 g/cc=ca. 49.61% and the tap density is 3.012 g/cc=ca. 64.6% of the theoritical density. The yield of usable mixed oxides is 2398.6 g=ca. 96.5% of the theoritical yield.

A metallographic examination of the pulverulent alloy shows particles with a homogeneous arrangement of the structure and a stabilized α phase. Sintered parts, produced from these alloy powders should have a higher creep resistance.

EXAMPLE 8

Preparation of a TiAl6V4 Alloy 1377.10 g $TiO_2$, 85.63 g $Al_2O_3$, 65.60 g $V_2O_5$ and 1034.52 g CaO (1:1) are homogeneously mixed and calcined for 18 hours at 1000° C. Subsequently, the calcined mixed oxide is comminuted by means of a crusher, a jet mill and a cross-beater mill to a particle size <1 mm. The mixed oxide has the following particle distribution curve:

| | |
|---|---|
| >500 μm = – | 63–90 μm = 8.4 w/o |
| 355–500 μm = 2.2 w/o | 45–63 μm = 3.5 w/o |
| 250–355 μm = 8.6 w/o | 32–45 μm = 1.3 w/o |
| 180–250 μm = 15.8 w/o | 25–32 μm = 1.0 w/o |
| 125–180 μm = 19.1 w/o | <25 μm = 1.5 w/o |
| 90–125 μm = 38.6 w/o | |

The bulk density of the mixed oxide is ca. 1.45 g/cc. The tap density is 2.28 g/cc. After calcining, the yield is 2605.8 g=ca. 98.7%.

1000 g of this mixed oxide are homogeneously mixed with 1051.62 g Ca (1:1.2 mole) and 228.50 g $KClO_4$ (≅0.20 mole $KClO_4$/mole of alloy powder) and green compacts with the dimensions of 50 mm diameter and 30 mm height are prepared therefrom.

Subsequently, these green compacts are placed in the reaction crucible, the reaction crucible is inserted into the furnace and the furnace is closed. The reaction chamber with the reduction crucible is evacuated at room temperature to a pressure of $<1\times10^{-4}$ bar and subsequently heated to 1300° C. and maintained at this temperature for 2 hours.

After the reduction, the reaction product is crushed and milled to a maximum particle size <2 mm, the crushed and milled reaction product is leached with dilute nitric acid, filtered and neutralized by washing. The alloy powder obtained is vacuum treated and dried. The yield of alloy powder is ca. 363.5 g≅94.8% based on the theoretical yield.

The alloy powder obtained has a bulk density of 2.03 g/cc≅46.56% and a tap density of 2.69 g/cc≅61.7% of the theoretical density.

The particle distribution curve of the alloy powder has the following composition:

| | |
|---|---|
| >500 μm = – | 45–63 μm = 9.8 w/o |
| 180–250 μm = 2.6 w/o | 32–45 μm = 13.2 w/o |
| 125–180 μm = 2.8 w/o | 25–32 μm = 15.5 w/o |
| 90–125 μm = 4.4 w/o | <25 μm = 46.4 w/o |
| 63 –90 μm = 5.2 w/o | |

Chemical analysis of the alloy powder reveals the following composition:

| | |
|---|---|
| Al = 5.95 w/o | C = 0.06 w/o |
| V = 4.05 w/o | O = 0.16 w/o |
| Fe = 0.03 w/o | Ca = 0.06 w/o |
| Si < 0.05 w/o | Mg ≦ 0.01 w/o |
| H = 0.015 w/o | rest Ti |
| N = 0.013 w/o | |

The metallographic investigation of the alloy powder shows that the alloy particles are present in a structurally homogeneous form with uniform $\alpha$ and $\beta$ distribution. The $\alpha$ portion is predominant amongst the alloy particles. The structure of the individual phases can be classified as fine globular to lamellar.

EXAMPLE 9

Preparation of a TiAl6V4 Alloy 1377.10 g $TiO_2$, 85.63 g $Al_2O_3$, 65.60 g $V_2O_5$ and 172.45 g CaO are mixed homogeneously (6:1) and calcined for 6 hours at 1300° C.

The calcined mixed oxide is comminuted by means of a crusher, a jet mill and a cross-beater mill to a particle size of <1 mm and has the following particle distribution curve:

| | |
|---|---|
| >500 μm = 6.4 w/o | 63–90 μm = 7.4 w/o |
| 355–500 μm = 11.9 w/o | 45–63 μm = 5.3 w/o |
| 250–355 μm = 23.6 w/o | 32–45 μm = 4.9 w/o |
| 180–250 μm = 16.3 w/o | 25–32 μm = 0.7 w/o |
| 125–180 μm = 13.1 w/o | <25 μm = 0.3 w/o |
| 90–125 μm = 10.0 w/o | |

The bulk density of the calcined mixed oxide phases is 1.58 g/cc and the tap density is ca. 2.48 g/cc. After the calcining, there is a yield of 1665.7 g≅97.9%, based on the theoretical yield.

1000 g of this mixed oxide are homogeneously mixed with 1991.80 g Ca and 11.43 g $KClO_4$ (≅0.01 mole $KClO_4$/mole of alloy powder) and green compacts with the dimensions of 50 mm diameter and 30 mm height are prepared therefrom.

The green compacts are subsequently placed in the reaction crucible, the reaction crucible is placed into the furnace and the furnace is then closed. The reaction chamber with the reduction crucible is subsequently evacuated at room temperature to a pressure of $<1\times10^{-6}$ bar and then heated to 1000° C. and maintained at this temperature for 8 hours.

After the reduction, the reaction product is crushed and milled to a particle size <2 mm and subsequently leached with formic acid, vacuum treated and dried. The yield of alloy powder is ca. 358 g≅93.5%, based on the theoretical yield.

The alloy powder obtained has a bulk density of 1.91 g/cc≅43.80% and a tap density of 2.76 g/cc≅63.6% of the theoretical density.

The particle distribution curve has the following composition:

| | |
|---|---|
| >500 μm = 5.9 w/o | 63–90 μm = 4.1 w/o |
| 355–500 μm = 16.6 w/o | 45–63 μm = 3.3 w/o |
| 250–355 μm = 18.3 w/o | 32–45 μm = 1.9 w/o |
| 180–250 μm = 28.1 w/o | 25–32 μm = 0.9 w/o |
| 125–180 μm = 12.5 w/o | <25 μm = 0.2 w/o |
| 90–125 μm = 8.0 w/o | |

The chemical analysis of the alloy powder shows the following composition:

| | |
|---|---|
| Al = 6.04 w/o | N = 0.020 w/o |
| V = 3.98 w/o | C = 0.05 w/o |
| Fe = 0.03 w/o | Ca = 0.05 w/o |
| Si < 0.05 w/o | Mg ≅ 0.01 w/o |
| H = 0.010 w/o | rest Ti |

The metallographic investigation of the alloy powder shows that the alloy particles are present in a structurally homogeneous form, the structural arrangement being lamellar to fine globular. The alloy consists predominantly of a high $\alpha$ portion and low $\beta$ portion.

EXAMPLE 10

Preparation of a TiAl3VlOFe3 Alloy 1325.2 g $TiO_2$, 55.2 g $Al_2O_3$, 168.6 g $V_2O_5$, 39.4 g $Fe_3O_4$ and 260.1 g CaO (4:1) are mixed homogeneously and calcined for 10 hours at 1300° C.

The calcined mixed oxide is comminuted by means of a crusher, a jet mill and a cross-beater mill to a particle size <1 mm and has the following particle distribution curve:

| | |
|---|---|
| >500 μm = 3.8 w/o | 63–90 μm = 9.2 w/o |
| 355–500 μm = 4.1 w/o | 45–63 μm = 6.1 w/o |
| 250–355 μm = 19.1 w/o | 32–45 μm = 2.8 w/o |
| 180–250 μm = 28.4 w/o | 25–32 μm = 1.1 w/o |
| 125–180 μm = 13.2 w/o | <25 μm = 0.4 w/o |
| 90–125 μm = 11.6 w/o | |

The bulk density of the mixed oxide is 1.54 g/cc and the tap density is 2.49 g/cc. After the calcining, the yield is 1869.6 g≅99.7% of the theoretical yield.

1000 g of this mixed oxide are homogeneously mixed with 598.8 g Ca (1:1.5) and 128.5 g $KClO_4$ (≅0.05 mole $KClO_4$/mole of alloy powder) and green compacts with the dimensions of 50 mm height and 30 mm diameter are prepared therefrom.

Subsequently, these green compacts are placed into the reaction crucible and the reaction crucible is then loaded into the furnace and evacuated at room temperature to a pressure of $<1\times10^{-6}$ bar and subsequently heated to 1200° C. The reaction time lasts 6 hours.

After the reduction, the reaction product is crushed and milled to a maximum particle size <2 mm, then leached with dilute hydrochloric acid, vacuum treated and dried. The yield of alloy powder is 501.8 g≅97.4% based on the theoretical yield.

The prepared alloy powder has a bulk density of 2.43 g/cc≅53.3% and a tap density of 2.978 g/cc≅65.2% of the theoretical density.

The measurement of the particle distribution curve of the alloy powder reveals the following values:

| | |
|---|---|
| >500 μm = 3.6 w/o | 63–90 μm = 10.1 w/o |
| 355–500 μm = 2.3 w/o | 45–63 μm = 8.3 w/o |
| 250–355 μm = 6.7 w/o | 32–45 μm = 1.1 w/o |
| 180–250 μm = 8.9 w/o | 25–32 μm = 10.2 w/o |
| 125–180 μm = 18.4 w/o | <25 μm = 3.0 w/o |
| 90–125 μm = 27.3 w/o | |

The chemical analysis of the alloy powder reveals the following composition:

| | |
|---|---|
| Al = 2.85 w/o | C = 0.06 w/o |
| V = 10.10 w/o | O = 0.145 w/o |
| Fe = 2.80 w/o | Ca = 0.08 w/o |
| Si < 0.05 w/o | Mg < 0.01 w/o |
| H = 0.013 w/o | rest Ti |
| N = 0.018 w/o | |

The metallographic investigation of the alloy powder shows particles with a homogeneous structure arrangement and stabilized $\alpha$ phase.

It is evident from the examples that the alloy powders, produced according to the inventive process, typically have a calcium content of 0.05 to 0.15 weight percent. This amount, however, does not have an effect on the quality and the processability of the alloy powders.

We claim:

1. In a process for the preparation of an alloy powder which can be sintered and is based on titanium by the calciothermal reduction of oxides of the metals forming the alloys in the presence of inert additives, the improvement which comprises:

(a) mixing titanium oxide with the oxides of the other components of the alloy in amounts, based on the metals, corresponding to the desired composition of the alloy, adding an alkaline earth oxide or alkaline earth carbonate in a molar ratio of metal oxides to be reduced to alkaline earth oxide or alkaline earth carbonate of 1:1 to 6:1, homogenizing the mixture, calcining the homogenized mixture at temperatures of 1000° C. to 1300° C. for 6 to 18 hours, and cooling and crushing and milling the calcined mixture to a particle size of $\leqq 1$ mm;

(b) adding calcium in small pieces to the particles in an amount equivalent to 1.2 to 2.0 times the oxygen content of the oxides to be reduced, adding a booster in a molar ratio of oxide to be reduced to booster of 1:0.01 to 1:0.2, mixing the thus formed reaction batch, molding the mixture into green compacts and (c) heating the green compacts in a closed off reaction crucible which was evacuated to an initial pressure of $1\times10^{-4}$ to $1\times10^{-6}$ bar, at a temperature of 1000° C. to 1300° C. for a period of 2 to 8 hours, and (d) cooling the reaction product and crushing and milling it to a particle size of $\leqq 2$ mm, leaching out the calcium oxide with a suitable dissolving agent which does not dissolve the alloy powder, and washing and drying the alloy powder obtained.

2. The process of claim 1 wherein the alkaline earth oxide or alkaline earth carbonate is added in step (a) in a molar ratio of metal oxides to be reduced to alkaline earth oxide or alkaline earth carbonate of 1:1 to 2:1.

3. The process of claim 1 or 2 wherein calcium oxide or calcium carbonate is used as the alkaline earth oxide or alkaline earth carbonate in step (a).

4. The process of claim 1 or 2 wherein in step (c), the reaction crucible is placed in a reaction furnace which can be evacuated and heated and after said heating, the crucible is removed from the furnace, and the reaction product is removed from the crucible prior to crushing and milling in step (d).

5. The process of claim 4 wherein one or more of the following processing steps:

(a) cooling the calcined oxide mixture, crushing and milling the calcined oxide mixture, (b) mixing the reaction mixture, molding the reaction mixture to green compacts, filling the green compacts into the reaction crucible, (c) placing the reaction crucible in the heatable furnace, (d) removing the reaction crucible from the reaction furnace, removing the reaction product from the reaction crucible, crushing and milling, leaching, drying of the reaction product are carried out in an atmosphere of a protective gas.

6. The process of claim 1 or 2 wherein one or more of the desired alloy components is added to the reaction mixture in step (b) in the form of a metal powder of a particle size of $\leqq 40$ μm.

7. The process of claim 1 or 2 wherein a calcium granulate of average particle size 0.5 to 8 mm is used in step (b).

8. The process of claim 1 or 2 wherein potassium perchlorate is used as booster.

9. The process of claim 7 wherein the gaseous potassium which emerges from the reaction furnace is absorbed in silica gel.

10. The process of claim 1 or 2 wherein the reaction product obtained in step (c) is subjected to a vacuum treatment at $1\times10^{-4}$ to $1\times10^{-7}$ bar at a temperature of 600° C. to 1000° C. for a period of 1 to 8 hours.

11. Alloy powder produced by the process of claim 1 or 2.

12. Aircraft parts formed from the alloy powder of claim 11.

* * * * *